US007651296B2

(12) United States Patent
Lindley

(10) Patent No.: US 7,651,296 B2
(45) Date of Patent: Jan. 26, 2010

(54) CONCRETE SCREED WITH REINFORCED SCREED BAR

(76) Inventor: Joseph W. Lindley, 201 Matthew Dr., Paducah, KY (US) 42001

( * ) Notice: Subject to any disclaimer, the term of this patent is extended or adjusted under 35 U.S.C. 154(b) by 465 days.

(21) Appl. No.: 10/587,530
(22) PCT Filed: Jan. 28, 2005

(86) PCT No.: PCT/US2005/003531

§ 371 (c)(1),
(2), (4) Date: Jul. 27, 2006

(87) PCT Pub. No.: WO2005/072471

PCT Pub. Date: Aug. 11, 2005

(65) Prior Publication Data

US 2007/0154260 A1 Jul. 5, 2007

Related U.S. Application Data

(60) Provisional application No. 60/540,125, filed on Jan. 29, 2004, provisional application No. 60/545,322, filed on Feb. 17, 2004.

(51) Int. Cl.
*E01C 19/38* (2006.01)

(52) U.S. Cl. ..... 404/118; 404/114
(58) Field of Classification Search ..... 404/101–118
See application file for complete search history.

(56) References Cited

U.S. PATENT DOCUMENTS

| | | | |
|---|---|---|---|
| 3,082,460 | A | 3/1963 | Haivala |
| 3,302,233 | A | 2/1967 | Sebastiani |
| 4,702,641 | A | 10/1987 | Naser et al. |
| 4,828,427 | A | 5/1989 | Nisenbaum |
| 5,244,305 | A | 9/1993 | Lindley |
| 5,324,085 | A | 6/1994 | Hintz, Jr. |
| 5,540,519 | A | 7/1996 | Weber |
| 5,725,279 | A | 3/1998 | Ward et al. |
| 5,857,803 | A | 1/1999 | Davis et al. |
| 5,909,981 | A | 6/1999 | Neuber, Jr. |
| 5,980,154 | A | 11/1999 | Record |
| 5,984,571 | A | 11/1999 | Owens |
| 6,200,065 | B1 | 3/2001 | Eitzen |
| 6,322,286 | B1 | 11/2001 | Rijkers |

*Primary Examiner*—Raymond W Addie
(74) *Attorney, Agent, or Firm*—Barnes & Thornburg LLP

(57) ABSTRACT

A concrete screed includes a screed bar, a bar mover adapted to move the screed bar over concrete, and a mount coupling the bar mover to the screed bar.

9 Claims, 11 Drawing Sheets

CONCRETE SCREED WITH REINFORCED SCREED BAR

CROSS-REFERENCE TO RELATED APPLICATIONS

This application is a U.S. national application under 37 C.F.R. § 371 (b) of International Application Serial No. PCT/US2005/003531 filed Jan. 28, 2005 which claims the benefit under 35 U.S.C. 119(e) of U.S. Provisional Application No. 60/540,125 filed Jan. 29, 2004 and U.S. Provisional Application No. 60/545,322 filed Feb. 17, 2004, both of which are hereby incorporated by reference herein.

BACKGROUND

The present disclosure relates to a concrete screed for screeding freshly-placed concrete.

A variety of tools are used to finish freshly placed concrete. One such tool is a concrete screed. A concrete screed is used to screed or otherwise level freshly-placed concrete before the concrete completely hardens. To do so, the screed is pulled or otherwise moved over the concrete to provide the concrete with a generally level top surface.

SUMMARY

According to the present disclosure, a concrete screed comprises a screed bar, a bar mover adapted to move the screed bar over concrete, and a mount coupling the bar mover to the screed bar. The mount includes a core positioned in the interior region of the screed bar and an anchor anchoring an attachment portion of the bar mover to the core without the attachment portion extending into the interior region. Such an arrangement facilitates ready coupling and uncoupling of the jaw mover to and from the screed bar and promotes the structural integrity of the screed bar. Promotion of the structural integrity of the screed bar allows the screed bar to be relatively long.

Illustratively, the mount includes a second anchor. Each anchor is positioned on the screed bar and connects to the core a foot of a frame included in the bar mover and used to support a vibrator that vibrates the screed bar. Each anchor includes a shoe positioned on the screed bar, a fastener extending through the screed bar to couple the shoe to the core, and a releasable retainer coupling the associated foot to the shoe for release therefrom.

Additional features of the disclosure will become apparent to those skilled in the art upon consideration of the following detailed description of illustrative embodiments exemplifying the best mode of carrying out the disclosure as presently perceived.

BRIEF DESCRIPTION OF THE DRAWINGS

The detailed description particularly refers to the following figures in which.

DETAILED DESCRIPTION

Figure 1:
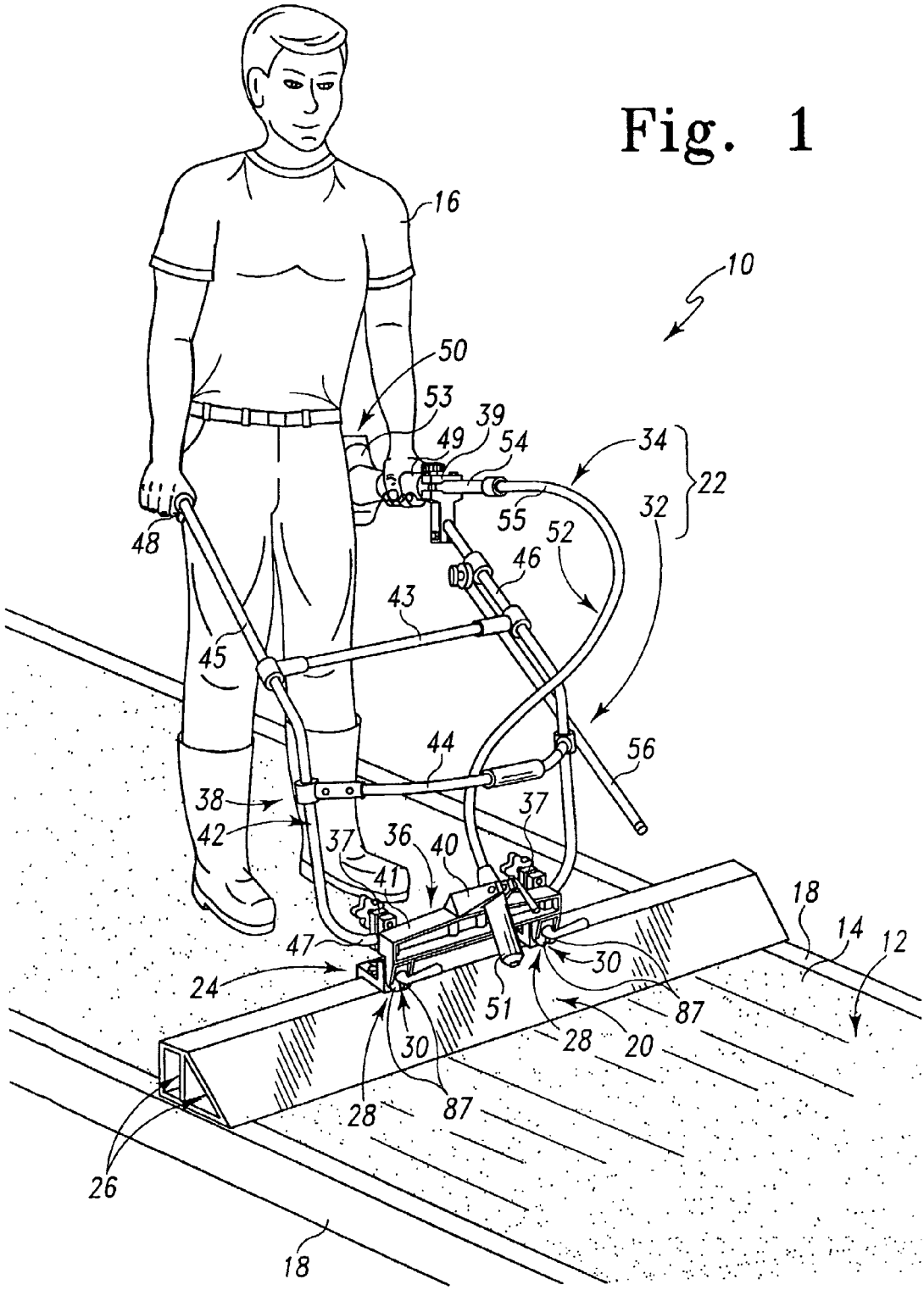
FIG. 1 is a perspective view of a first concrete screed showing a first mount coupling a first bar mover including a frame supporting a vibrator to a screed bar adapted to screed freshly-placed concrete.

A concrete screed 10 is adapted to screed freshly-placed concrete 12 to provide concrete 12 with a generally level top surface 14, as shown, for example, in FIG. 1. To do so, a person 16 pulls or otherwise moves screed 10 along forms 18 or other concrete-containment structures over the freshly-placed concrete 12 to strike off high areas of concrete and fill in low areas of concrete. Screed 10 includes a screed bar 20 which moves on forms 18 to engage concrete 12, a jaw mover 22 which person 16 manipulates to move screed bar 20, and a mount 24 coupling jaw mover 22 to screed bar 20.

Figure 2:
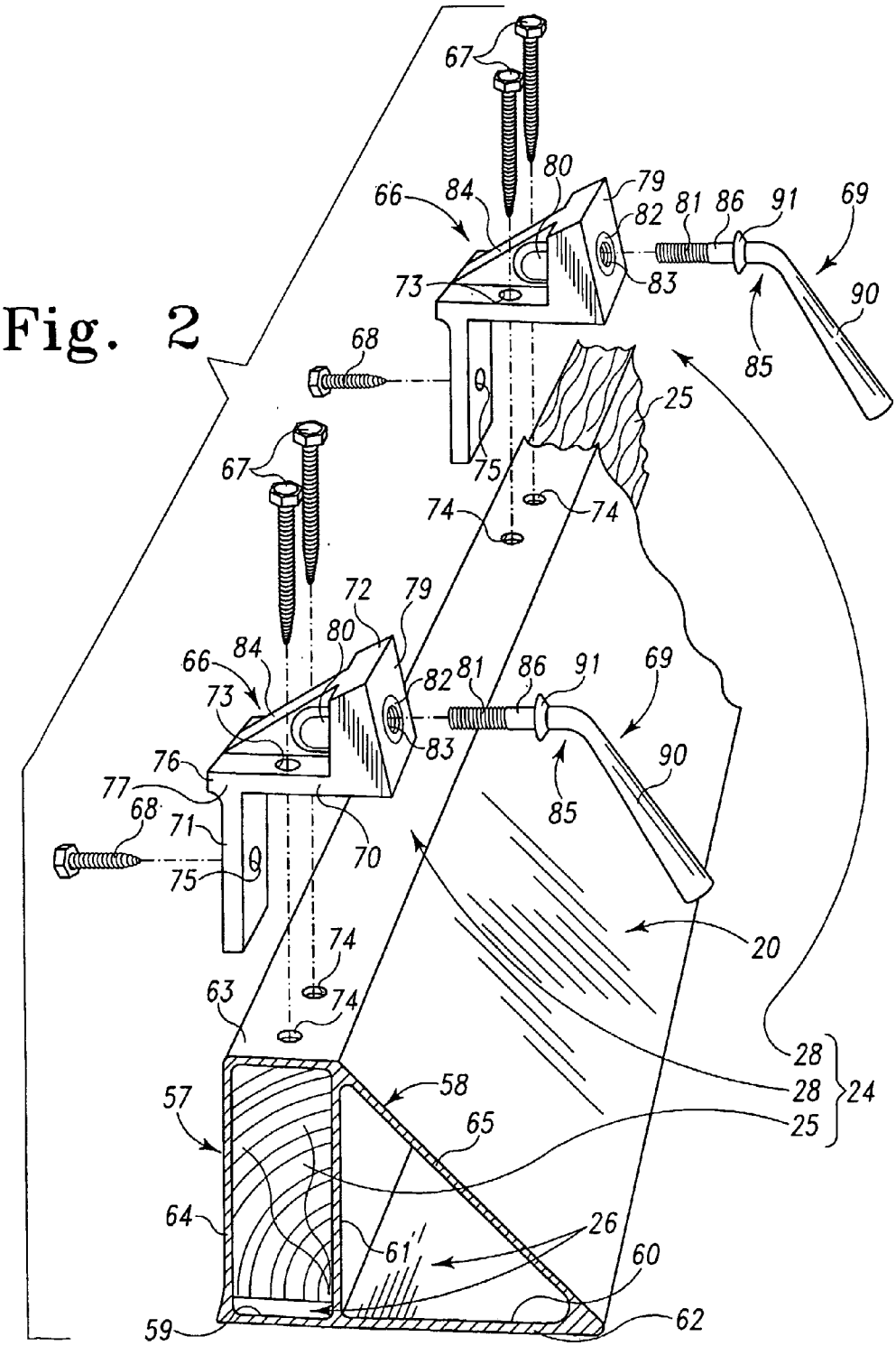
FIG. 2 is an exploded perspective view showing components of the first mount which includes a core located in a rectangular chamber formed in the screed bar and a pair of first anchors configured to be coupled to the core, each first anchor including a pair of shoes configured to be positioned on the screed bar, a plurality of fasteners configured to couple the shoes to the core, and a pair of releasable retainers that are configured to couple feet of the frame to the shoes for release therefrom and include lever portions to facilitate quick coupling and release of the feet.

Mount 24 includes a core 25 positioned in an interior region 26 of screed bar 20 and a pair of anchors 28, as shown, for example, in FIGS. 1 and 2. Each anchor 28 anchors an attachment portion or foot 30 of mover 22 to core 25 without foot 30 extending into interior region 26. Each anchor 28 thus provides means for anchoring foot 30 to core 25 without foot 30 extending into interior region 26. Such an arrangement facilitates coupling of feet 30 to screed bar 20 and removal of feet 30 from screed bar 20 and promotes the structural integrity of screed bar 20 since no apertures need to be formed in screed bar 20 to allow extension of feet 30 through screed bar 20 into interior region 26 to mount jaw mover 22. Promotion of the structural integrity of screed bar 20 allows screed bar 20 to be relatively long (e.g., 20 feet (6.096 m), 24 feet (7.315 m), 28 feet (9.534 m), 30 feet (9.144 m)).

Figure 3:
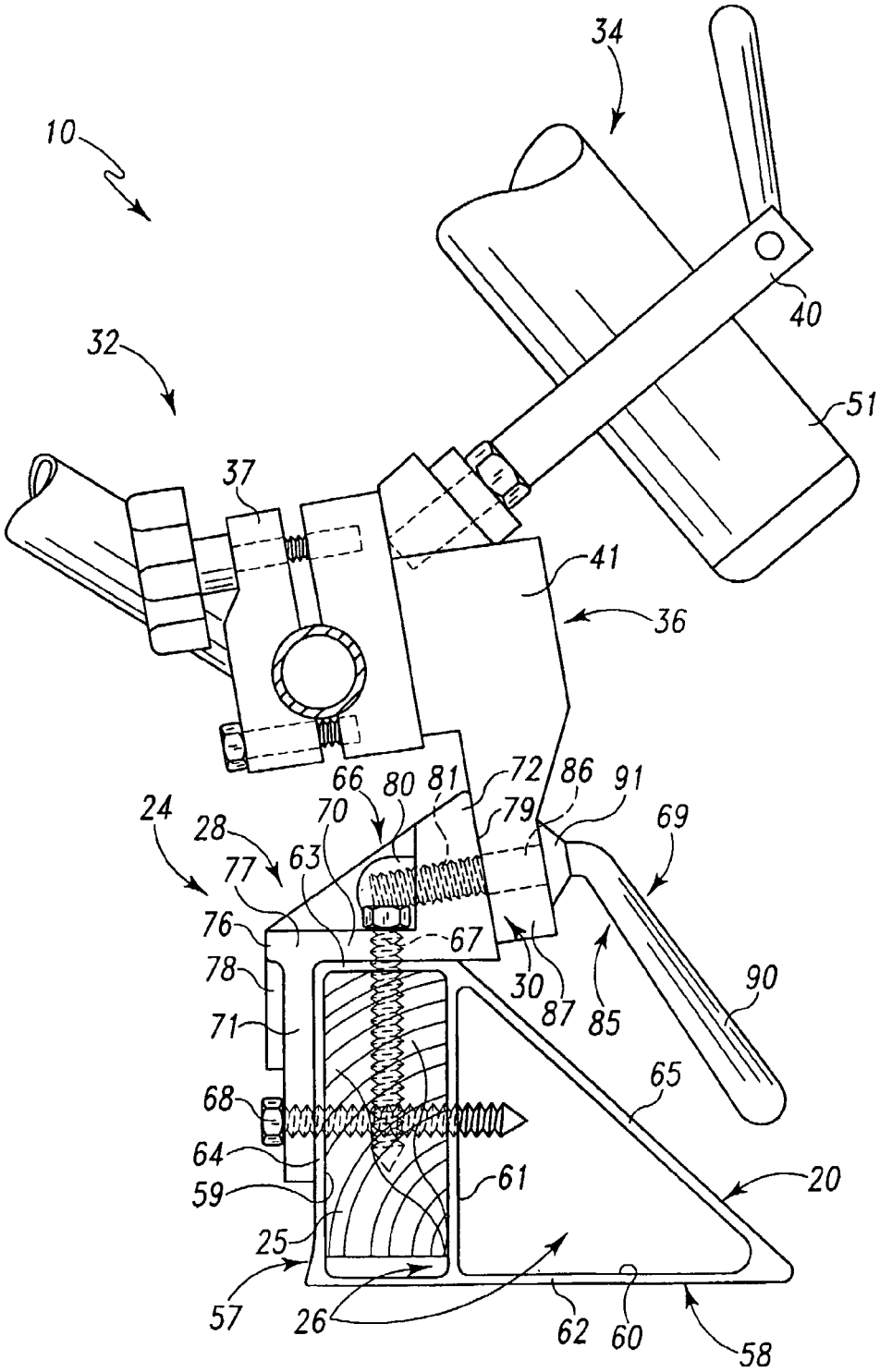
FIG. 3 is a side elevation view showing the first mount coupling the bar mover to the screed bar.

Jaw mover 22 includes a frame 32 and a vibrator 34, as shown, for example, in FIGS. 1 and 3. Mount 24 couples frame 32 to screed bar 20. Vibrator 34 is coupled to frame 32 and configured to vibrate frame 32 and thus vibrate screed bar 20 due to transmission of vibrations from vibrator 34 through frame 32 and mount 24 to screed bar 20 to facilitate screeding concrete 12.

Frame 32 includes a yoke 36, a pair of releasable support clamps 37, a support 38, a releasable connector clamp 39, and a releasable head clamp 40, as shown, for example, in FIG. 1. Yoke 36 includes a generally horizontal strut 41 and feet 30 which depend from strut 41 in spaced-apart relation to one another to be anchored by anchors 28. Support clamps 37 are coupled to strut 41 and are coupled to support 38 for release of support 38.

Support 38 includes a generally U-shaped main member 42, an upper transverse member 43, and a lower transverse member 44, as shown, for example, in FIG. 1. Upper and lower transverse members 43, 44 are coupled to parallel first and second side portions 45, 46 that are included in main member 42 and are connected by a transversely extending bottom portion 47 that is also included in main member 42 and is coupled to support clamps 37. A first side handle 48 is coupled to first side portion 45 and adapted to be gripped by person 16 to control screed 10. A handle 49 of vibrator 34 provides a second side handle adapted to be gripped by person 16 to control screed 10.

Vibrator 34 includes a power unit 50, vibration head 51, and a connector 52, as shown, for example, in FIG. 1. Power unit 50 operates through connector 52 to rotate an eccentric (not shown) included in vibration head 51 to vibrate vibration head 51. Power unit 50 includes a motor 53 (e.g., electric motor or fuel-powered motor) that rotates a shaft (not shown) extending to vibration head 51 through an inflexible tube 54 of connector 52 and a flexible tube 55 of connector 52. Connector clamp 39 is coupled to second side portion 46 of support and coupled to inflexible tube 54 of connector 52 for release of connector 52. Head clamp 40 is coupled to strut 41 and coupled to vibration head 51 for release of vibration head 51. As such, vibrator 34 can be coupled to frame 32 by use of clamps 39, 40 and can uncoupled from frame 32 by use of clamps 39, 40 to allow use of vibrator 34 as a stand-alone device to vibrate concrete 12.

Figure 6:
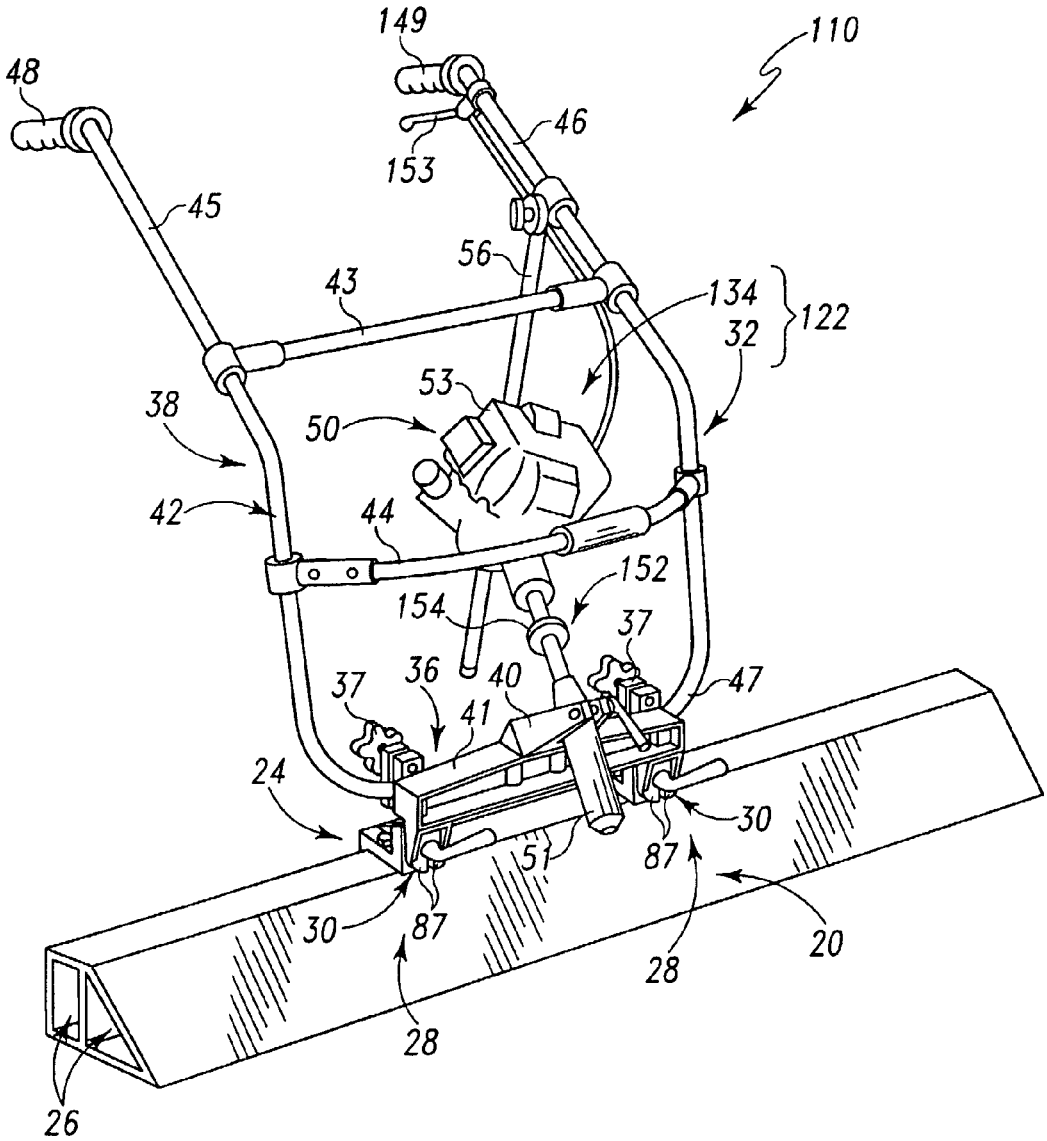
FIG. 6 is a perspective view of a second concrete screed showing use of the first mount to couple a second jaw mover to the screed bar.
Figure 7:
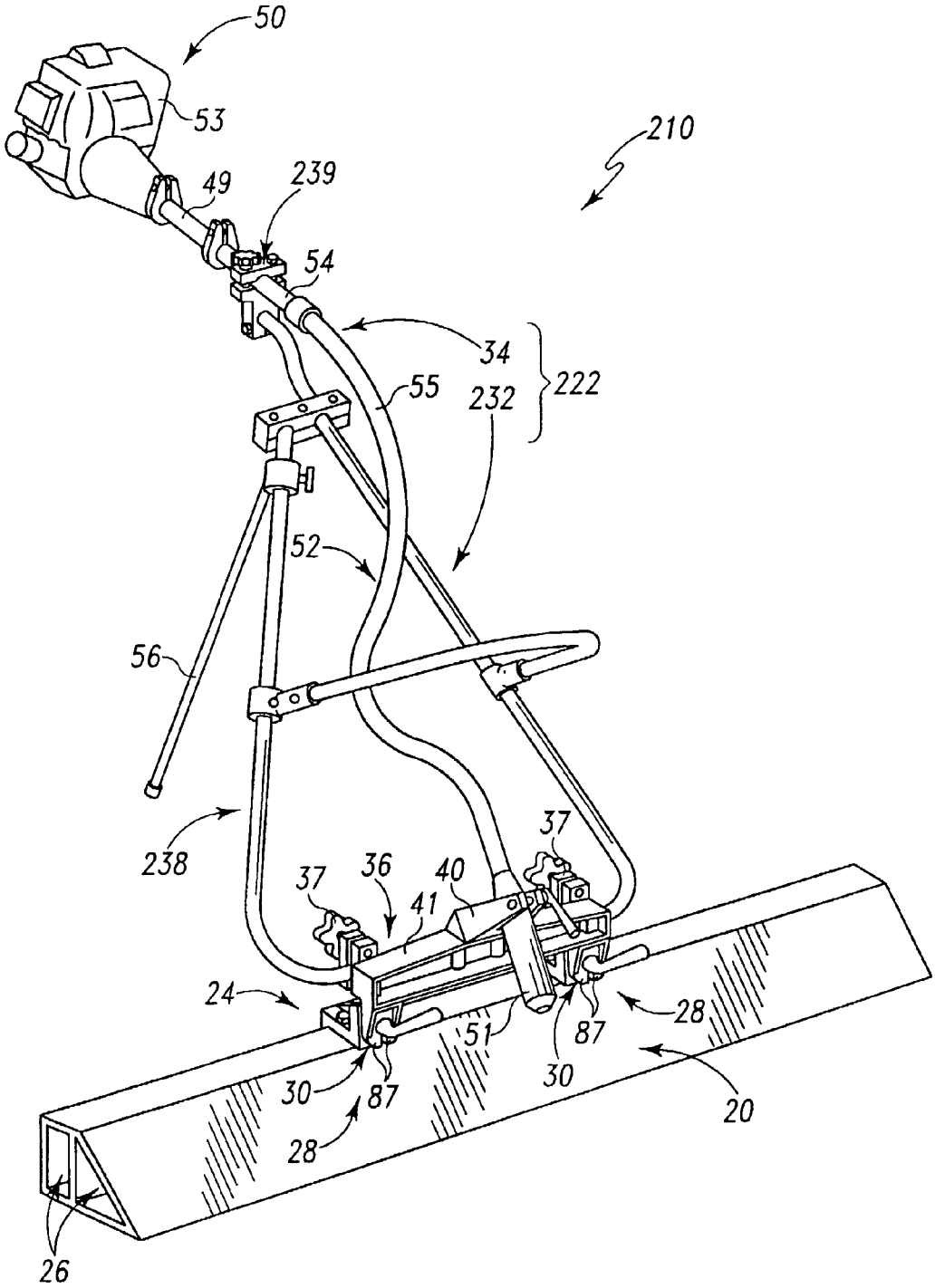
FIG. 7 is a perspective view of a third concrete screed showing use of the first mount to couple a third jaw mover to the screed bar.

Frame 32 includes a lockable stand 56 coupled to second side portion 46, as shown, for example, in FIGS. 1, 6, and 7. Stand 56 is pivotable between a use position shown, for example, in FIGS. 6 and 7 and a storage position shown, for example, in FIG. 1.

Figure 4:
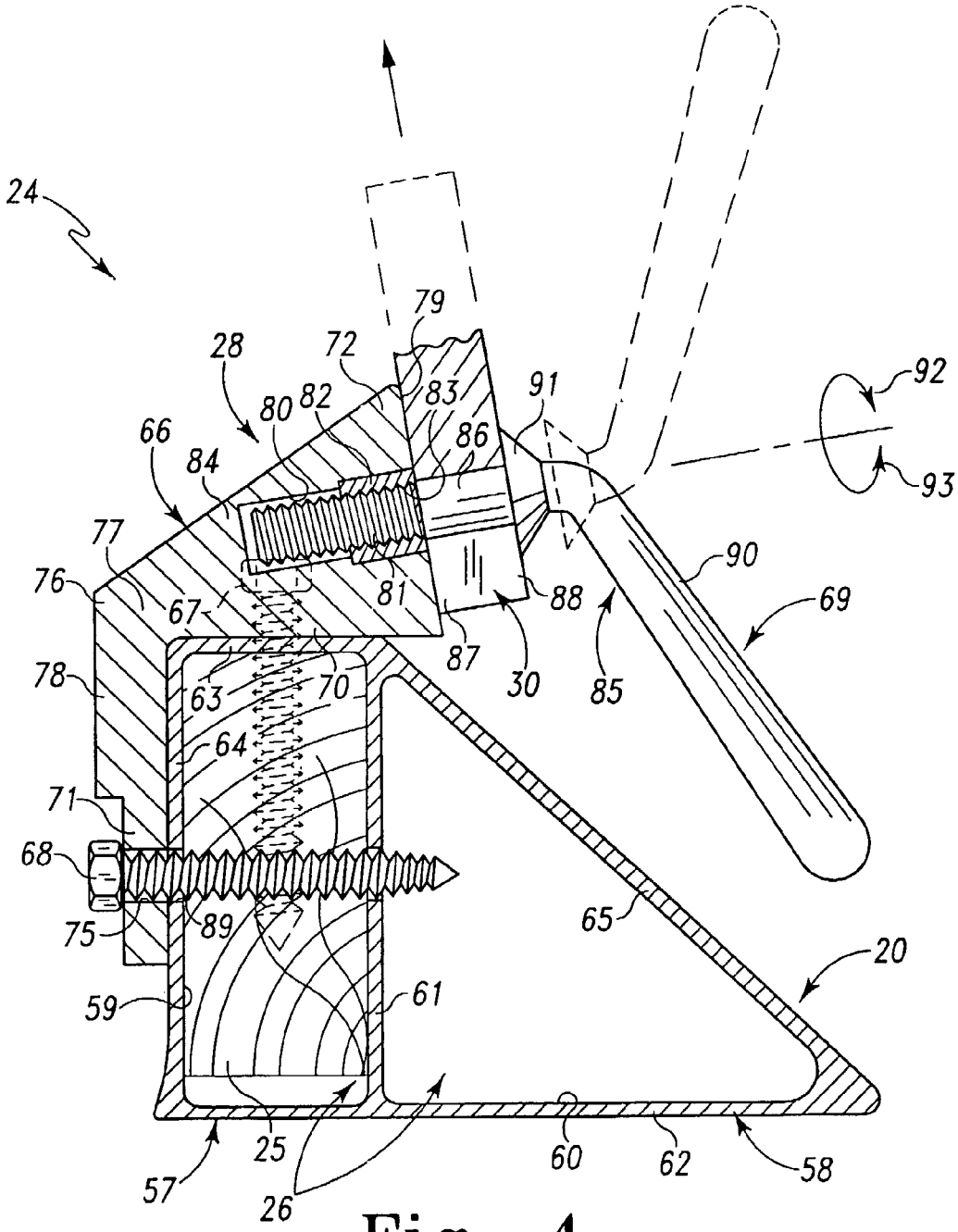
FIG. 4 is a sectional view taken along lines 4-4 of FIG. 2 showing a shoe of a first anchor coupled to the core by fasteners and showing a foot of the frame captured between a releasable retainer of the first anchor and the shoe for release therefrom.
Figure 5:
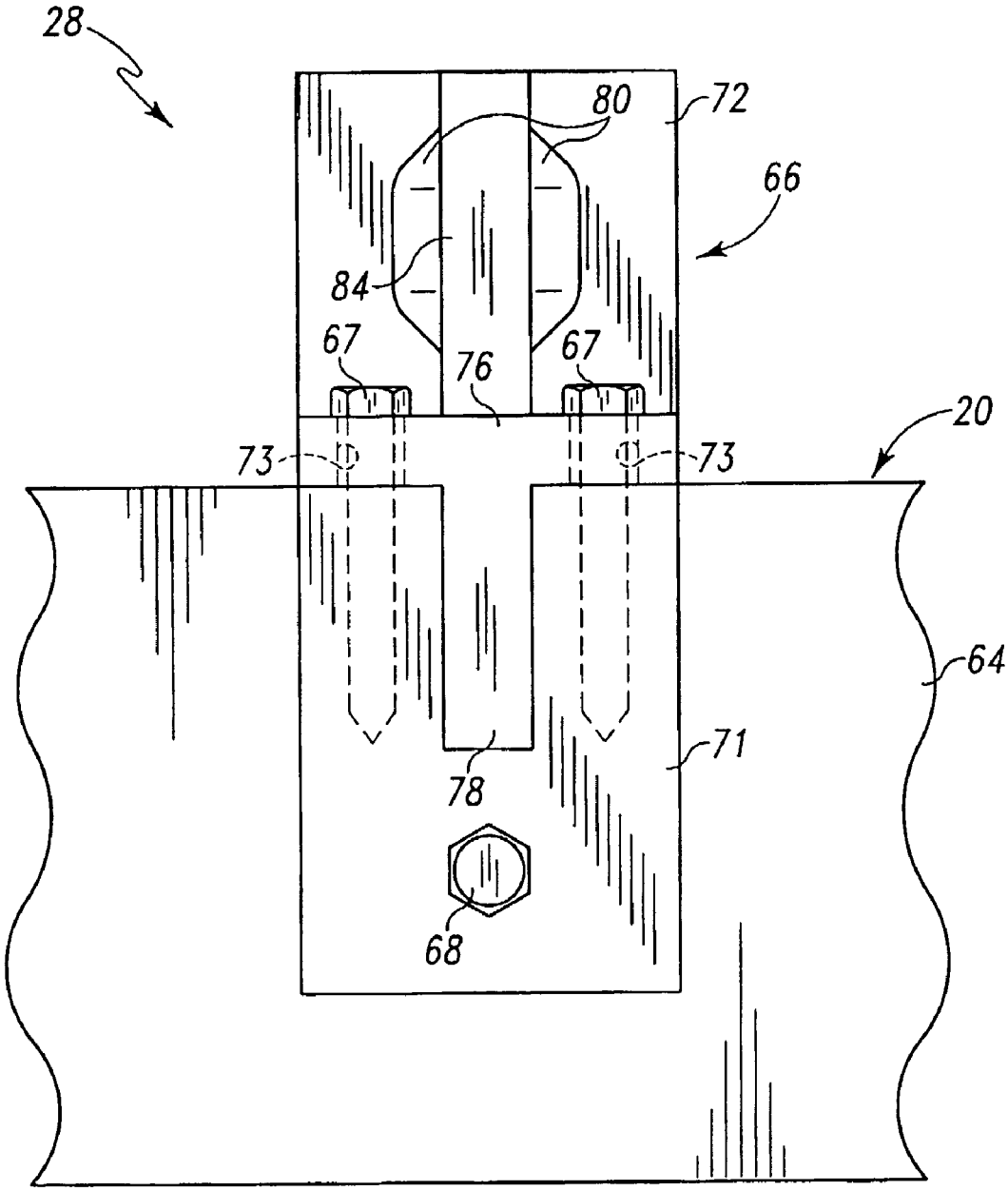
FIG. 5 is a rear elevation view of one of the first anchors positioned on the screed bar.

Screed bar 20 is tubular and includes a rectangular tubular portion 57 and a triangular tubular portion 58, as shown, for example, in FIGS. 2-4. Rectangular tubular portion 57 has a rectangle-shaped cross-section and is formed to include a rectangular first chamber 59. Triangular tubular portion 58 has a triangle-shaped cross-section and is formed to include a triangular second chamber 60. Chambers 59, 60 are separated from one another by a vertical common wall 61 shared by rectangular tubular portion 57 and triangular tubular portion 58. Portions 57, 58 cooperate to provide screed bar 20 with a bottom wall 62. Rectangular tubular portion 57 provides screed bar 20 with a horizontal top wall 63 and a vertical rear wall 64 connecting top wall 63 and bottom wall 62. Triangular tubular portion 58 provides screed bar 20 with an inclined wall 65 that connects top wall 63 and bottom wall 62 and forms a hypotenuse of triangular tubular portion 58.

Mount 24 includes core 25 and the pair of anchors 28 for anchoring feet 30 to core 25, as shown, for example, in FIGS. 2-4. Core 25 is positioned in and substantially fills first chamber 59 and is positioned in face-to-face contact with walls 61, 63, 64 to reinforce bar 20. Illustratively, core 25 is made of wood (e.g., #1 yellow pine). It is within the scope of this disclosure to use nylon in place of wood. Core 25 is long enough so that core 25 extends at least from one anchor 28 to the other anchor 28. As such, illustratively, core 25 extends only a portion (e.g., about two feet) of the length of bar 20. It is within the scope of this disclosure for core 25 to extend the length of bar 20.

Each anchor 28 is configured to anchor a foot 30 to core 25 without foot 30 extending into interior region 26 and either chamber 59, 60 of bar 20, as shown, for example, in FIGS. 2-4. Anchor 28 includes a shoe 66, a pair of vertical fasteners 67 for coupling shoe 66 to core 25, a horizontal fastener 68 for coupling shoe 66 to core 25, and a releasable retainer 69 for coupling foot 30 to shoe 66 for release therefrom.

Shoe 66 includes a horizontal intermediate plate 70, a vertical rear plate 71, and an inclined retainer receiver front plate 72, as shown, for example, in FIGS. 2-5. Intermediate plate 70 is positioned on top wall 63 in face-to-face contact therewith. Vertical fasteners 67 extend through apertures 73 formed in plate 70 and apertures 74 formed in top wall 63 into core 25. Rear plate 71 depends from a first end of intermediate plate 70 along rear wall 64 in face-to-face contact with rear wall 64. Horizontal fastener 68 extends through an aperture 75 formed in rear plate 71 and an aperture 89 formed in rear wall 64 into core 25. A junction reinforcement rib 76 extends horizontally along a junction 77 formed between intermediate plate 70 and rear plate 71 to reinforce junction 77. A rear plate reinforcement rib 78 extends vertically downwardly from rib 76 along rear plate 71 to reinforce rear plate 71. Ribs 76, 77 thus formed a T-shaped reinforcement.

Front plate 72 is coupled to a second end of intermediate plate 70, as shown, for example, in FIGS. 2-5. Front plate 72 is inclined (i.e., non-horizontal and non-vertical) to provide sufficient space for retainer 69 to rotate without engagement against wall 65 of triangular tubular portion 58. As such, front plate 72 includes an inclined surface 79 for face-to-face contact against foot 30 and is formed to include an inclined bore 80 for receiving a threaded portion 81 of retainer 69. A protective threaded sleeve 82 made, for example, of steel is inserted into bore 80 for engagement with threaded portion 81 in an inclined threaded channel 83 formed in sleeve 82 to protect the material of shoe 66 which is made, for example, of aluminum. It is within the scope of this disclosure to omit sleeve 82 and to thread bore 80 for engagement with threaded portion 81. In such a case, shoe 66 may be made of aluminum or some other material such as steel.

A vertical reinforcement web 84 extends from front plate 72 to intermediate plate 70 to reinforce front plate 72, as shown, for example, in FIGS. 2-5. Web 83 extends between vertical fasteners 67.

Retainer 69 includes threaded portion 81, a lever portion 85, and an unthreaded foot receiver portion 86 connecting threaded portion 81 and lever portion 85, as shown, for example, in FIGS. 2-4. Threaded portion 81 is received in channel 83 for threaded engagement therewith. Foot 30 includes a pair of tangs 87 which define an open-ended slot 88 therebetween to receive unthreaded foot receiver portion 86 therein.

Lever portion 83 includes a lever arm 90 and a frustoconical portion 91, as shown, for example, in FIG. 4. Lever arm 90 is adapted to be gripped and rotated by person 16 in a coupling direction 92 to press frustoconical portion 91 against tangs 87 to capture foot 30 between frustoconical portion 91 and inclined surface 79 and in an uncoupling direction 93 to release foot 30. As such, retainer 69 acts as a quick-release retainer to facilitate quick and convenient coupling and uncoupling of jaw mover 22 to and from screed bar 20 without the use of a tool.

The arrangement of anchor 28 facilitates ready coupling and uncoupling of feet 30 to and from screed bar 20 and promotes the structural integrity of screed bar 20 since no apertures need to be formed in screed bar 20 to allow extension of feet 30 through screed bar 20 into interior region 26 to mount mover 22 to screed bar 20. Promotion of the structural integrity of screed bar 20 allows screed bar 20 to be relatively long (e.g, 20 feet (6.096 m), 24 feet (7.315 m), 28 feet (9.534 m), 30 feet (9.144 m)).

Mount 20 is configured for use with a variety of jaw movers to couple such jaw movers to screed bar 20. For example, mount 20 can be used with any of jaw mover 122 shown, for example, in FIG. 6, jaw mover 222 shown, for example, in FIG. 7, and jaw mover 322 shown, for example, in FIG. 8.

A screed 110 shown, for example, in FIG. 6 is similar to screed 10 except that jaw mover 122 has replaced jaw mover 22. Jaw mover 122 includes frame 32 and a vibrator 134. Vibrator 134 includes power unit 50, vibration head 51 coupled to head clamp 40, and a connector 152 connecting power unit 50 and vibration head 51. A speed control device 153 for controlling the operating speed of power unit 50 is coupled to first side portion 46 next to a side handle 149. Connector 152 includes a vibration isolator 154 to isolate vibration of vibration head 51 from power unit 50.

A screed 210 shown, for example, in FIG. 7 is similar to screed 10 except that jaw mover 222 has replaced jaw mover 22. Jaw mover 222 includes a frame 232 and vibrator 34 coupled to frame 232. A support 238 of frame 232 is coupled to clamps 37. A connector clamp 239 is coupled to support 238 and inflexible tube 54 of connector 52. Connector 52 provides a single handle 49 of screed 210.

Figure 8:
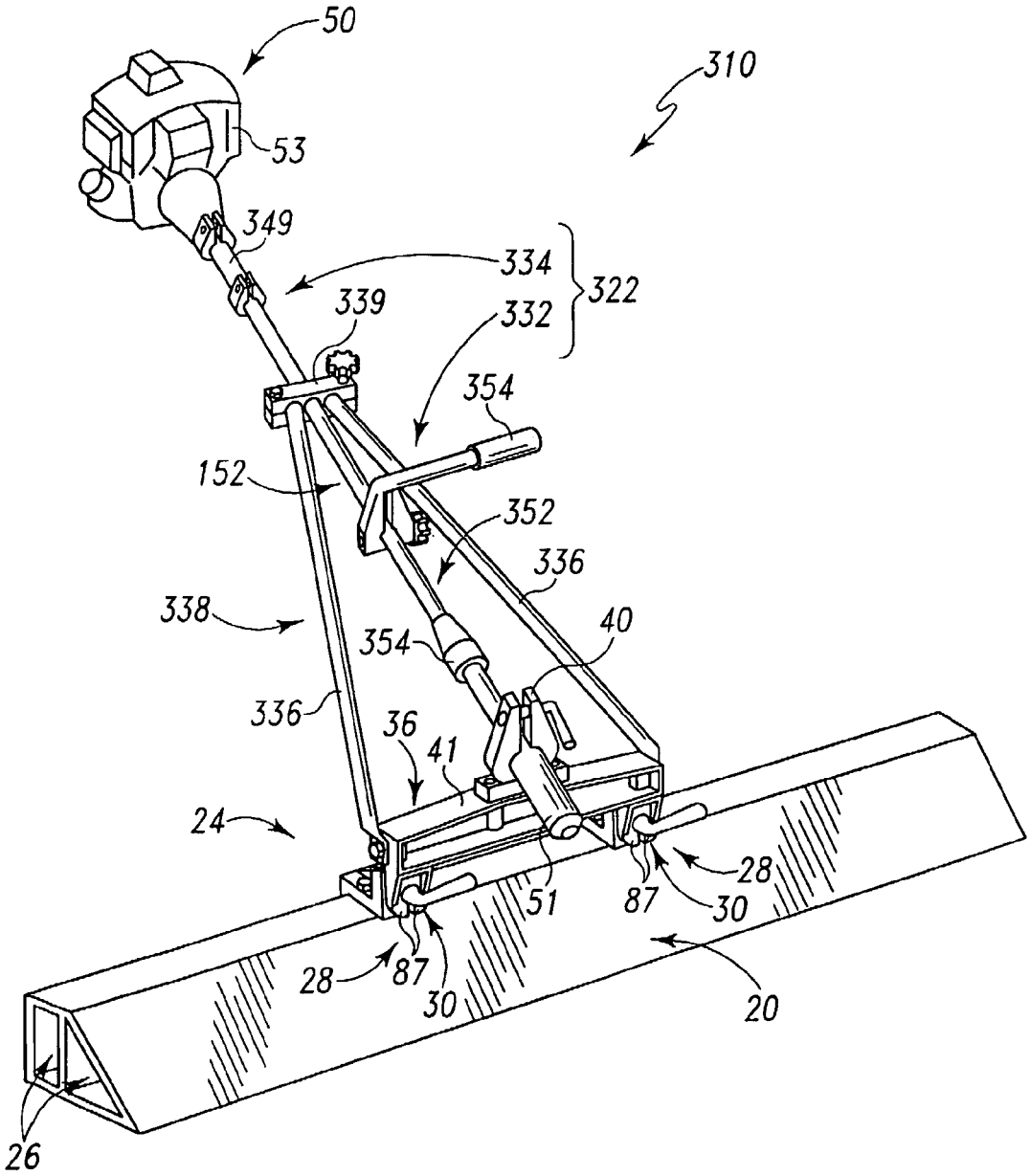
FIG. 8 is a perspective view of a fourth concrete screed showing use of the first mount to couple a fourth jaw mover to the screed bar.

A screed 310 shown, for example, in FIG. 8 is similar to screed 10 except that jaw mover 322 has replaced jaw mover 22. Jaw mover 322 includes a frame 332 and a vibrator 334. A support 338 of frame 332 includes a pair of links 336 connecting strut 41 and a connector clamp 339. Vibrator 334 includes power unit 50, vibration head 51 coupled to head clamp 40, and a connector 352 connecting power unit 50 and vibration head 51. Connector 352 is coupled to connector clamp 339 and includes a vibration isolator 354 to isolate vibration of vibration head 51 from power unit 50. Connector 352 includes a first handle 349. A second handle 354 is coupled to connector 352.

Figure 9:
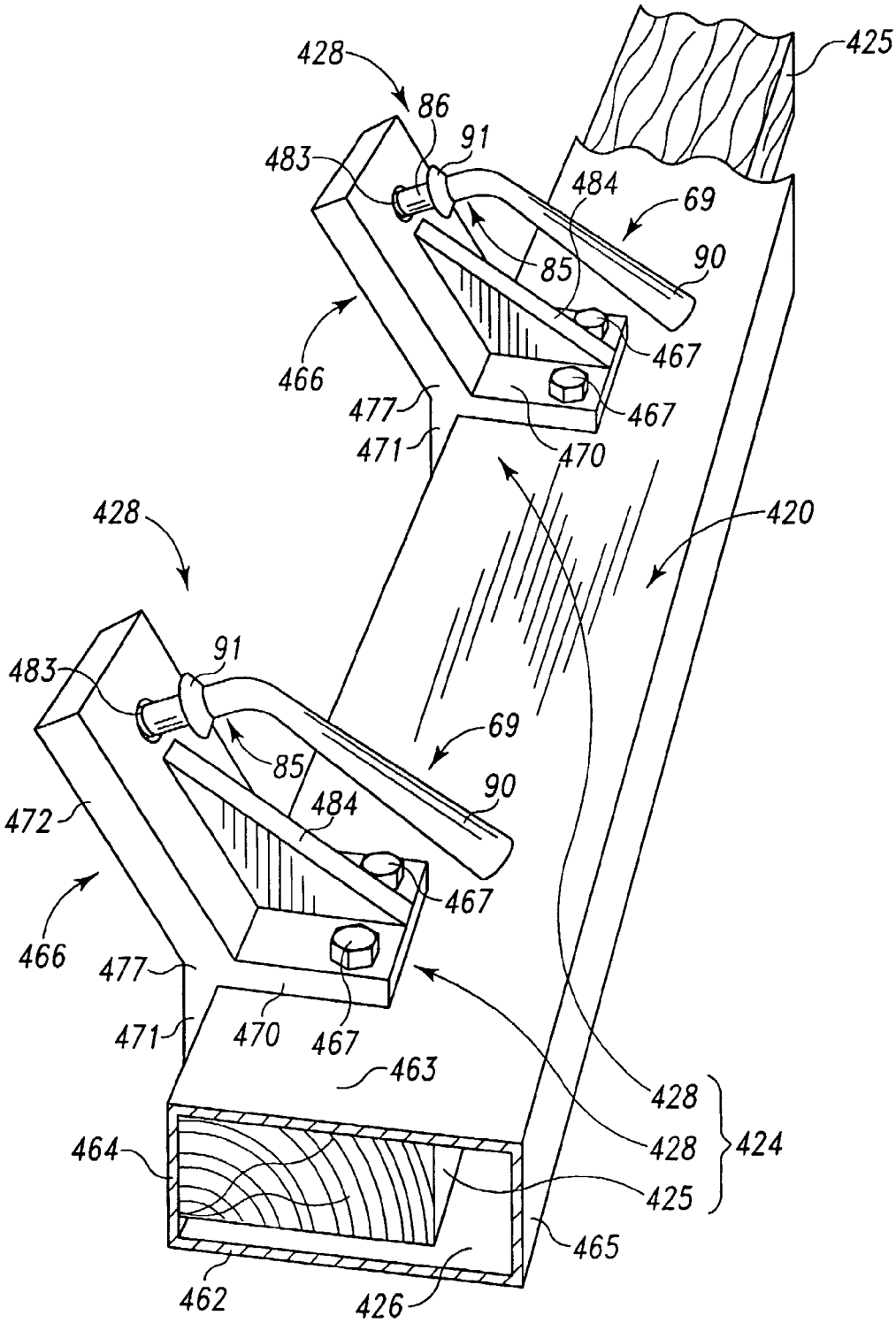
FIG. 9 is a perspective view showing a second mount configured to couple a jaw mover to a second screed bar and showing that the second mount includes a core positioned in the second screed bar and a pair of second anchors which are coupled to the core.

A mount 424 shown, for example, in FIG. 9 is configured to couple any of jaw movers 22, 122, 222, 322 to a rectangular screed bar 420. Mount 424 includes a core 425 and a pair of anchors 428. Core 425 is positioned in an interior region 426 formed in screed bar 420. Each anchor 428 anchors attachment portion or foot 30 to core 425 without foot 30 extending into interior region 426. Each anchor 28 thus provides means for anchoring foot 30 to core 425 without foot 30 extending into interior region 426. Such an arrangement facilitates coupling of feet 30 to screed bar 420 and removal of feet 30 from screed bar 420 and promotes the structural integrity of screed bar 420 since no apertures need to be formed in screed bar 20 to allow extension of feet 30 through screed bar 420 into interior region 426 to mount the jaw mover. Promotion of the structural integrity of screed bar 420 allows screed bar 20 to be relatively long (e.g., 20 feet (6.096 m), 24 feet (7.315 m), 28 feet (9.534 m), 30 feet (9.144 m)).

Figure 10:
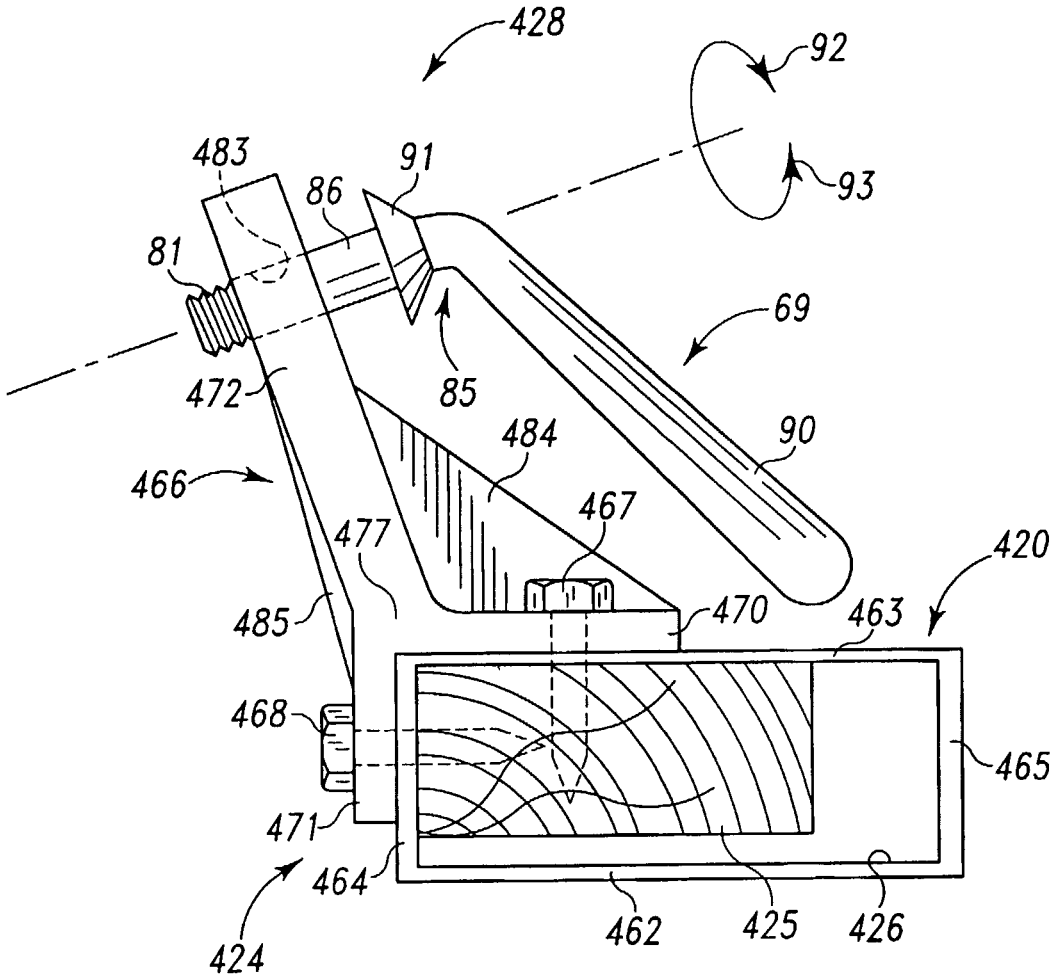
FIG. 10 is a side elevation view showing one of the second anchors coupling a frame foot to the core located in the second screed bar.

Each anchor 428 includes a shoe 466, a pair of vertical fasteners 467, a horizontal fastener 468, and releasable retainer 69, as shown, for example, in FIGS. 9 and 10. Shoe 466 includes an upper plate 470 extending along a top wall 463 of screed bar 420, a rear plate 471 depending from upper plate 470 and extending along a rear wall 464 of screed bar 420, and an inclined retainer receiver plate 472 extending upwardly from a junction 477 formed between upper plate 470 and rear plate 471 and receiving releasable retainer 69. Fasteners 467 extend through upper plate 470 and top wall 463 into core 425. Fastener 468 extends through rear plate 471 and rear wall 464 into core 425. Retainer plate 472 is inclined so that a channel 483 formed in plate 472 is inclined to orient retainer 69 in manner that allows rotation of retainer 69 in coupling direction 92 to capture foot 30 between frustoconical portion 91 and retainer plate 472 and uncoupling direction 93 to allow release of foot 30. A first reinforcement web 484 extends from retainer plate 472 to upper plate 470 and between fasteners 467 and a second reinforcement web 485 extends from retainer plate 472 to rear plate 470 to reinforce junction 477 between plates 470, 471, 472. It is within the scope of this disclosure for bottom wall 462 and front wall 465 to be imperforate.

Figure 11:
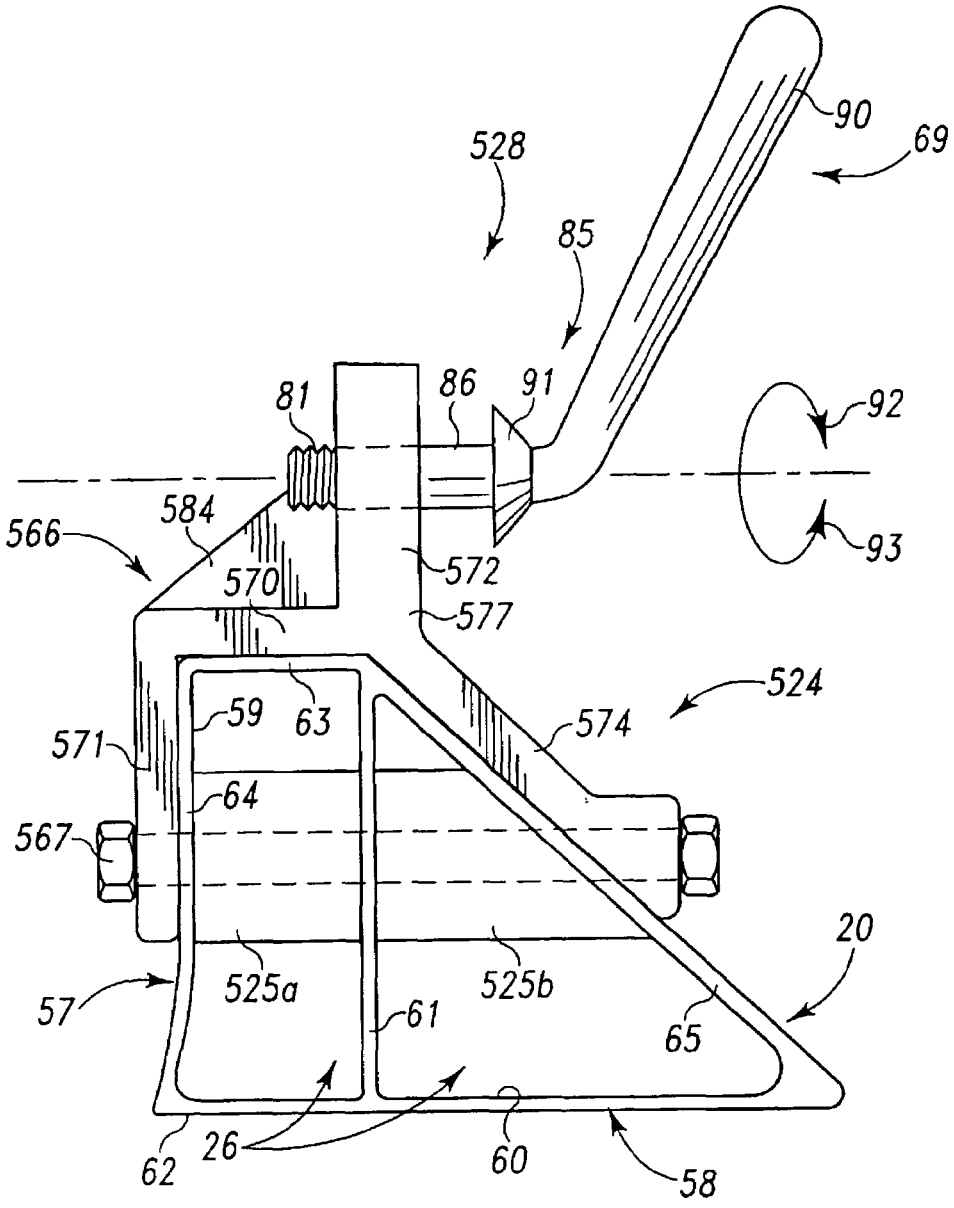
FIG. 11 is a side elevation view showing a third anchor coupling a frame foot to the core located in the first screed bar.

A mount 524 shown, for example, in FIG. 11 is configured to couple any of jaw movers 22, 122, 222, 322 to screed bar 20. Mount 524 includes a core 525 and a pair of anchors 528. Core 525 includes a first core member 525a positioned in first chamber 59 and a second core member 525*b* positioned in second chamber 60. Each anchor 528 anchors attachment portion or foot 30 to core 525 without foot 30 extending into interior region 526. Each anchor 528 thus provides means for anchoring foot 30 to core 525 without foot 30 extending into interior region 526. Such an arrangement facilitates coupling of feet 30 to screed bar 20 and removal of feet 30 from screed bar 20 and promotes the structural integrity of screed bar 20 since no apertures need to be formed in screed bar 20 to allow extension of feet 30 through screed bar 20 into interior region 26 to mount the jaw mover. Promotion of the structural integrity of screed bar 20 allows screed bar 20 to be relatively long (e.g., 20 feet (6.096 m), 24 feet (7.315 m), 28 feet (9.534 m), 30 feet (9.144 m)).

Each anchor 528 includes a shoe 566, a fastener 567, and releasable retainer 69, as shown, for example, in FIG. 11. Shoe 566 includes a rear plate 571 extending along rear wall 57, a front plate 574 extending along inclined wall 65, an intermediate plate 570 connecting rear plate 571 and front plate 574 and extending along top wall 63, and a retainer receiver plate 572 extending upwardly from a junction 577 formed between front plate 574 and intermediate plate 570. Retainer 69 is coupled to retainer receiver plate 572. Fastener 567 extends through rear plate 571, the first core member 525*a*, common wall 61, second core member 525*b*, inclined wall 65, and front plate 574. A reinforcement web 584 extends between retainer receiver plate 572 and intermediate plate 570.

The invention claimed is:

1. A concrete screed comprising a frame including a first foot, a vibrator coupled to the frame, a tubular screed bar formed to include an interior region, and a mount coupling the frame to the screed bar to transmit vibration caused by the vibrator to the screed bar, the mount including a core positioned in the interior region of the screed bar to reinforce the screed bar and means for anchoring the first foot to the core without the first foot extending into the interior region, wherein the screed bar includes a rectangular tubular portion and a triangular tubular portion, the rectangular tubular portion has a rectangle-shaped cross-section and is formed to include a first chamber, the triangular tubular portion has a triangle-shaped cross-section and is formed to include a second chamber separated from the first chamber by a vertical common wall shared by the rectangular tubular portion and the triangular tubular portion, the core is positioned in the first chamber, and the anchoring means includes a shoe positioned on the rectangular tubular portion, a first fastener extending from the shoe through the rectangular tubular portion into the core to couple the shoe to the core, and a releasable retainer coupling the first foot to the shoe for release therefrom, and wherein the rectangular tubular portion includes a horizontal top wall extending rearwardly from the common wall and a vertical rear wall parallel to the common wall, the triangular tubular portion includes an inclined wall extending forwardly from the common wall, the core includes a first core member positioned in the first chamber between the rear wall and the common wall and a second core member positioned in the second chamber between the common wall and the inclined wall, and the anchoring means includes a shoe, a fastener, and a releasable retainer, the shoe includes a rear plate extending along the rear wall, a front plate extending along the inclined wall, an intermediate plate connecting the rear plate and the front plate and extending along the top wall, and a retainer receiver plate extending upwardly from a junction formed between the front plate and the intermediate plate, the releasable retainer is coupled to the retainer receiver plate, and the fastener extends through the rear plate, the first core member, the common wall, the second core member, the inclined wall, and the front plate.

2. A concrete screed comprising a frame including a first foot, a vibrator coupled to the frame, a tubular screed bar formed to include an interior region, and a mount coupling the frame to the screed bar to transmit vibration caused by the vibrator to the screed bar, the mount including a core positioned in the interior region of the screed bar to reinforce the screed bar and means for anchoring the first foot to the core without the first foot extending into the interior region, wherein the screed bar includes a horizontal top wall and a vertical rear wall extending downwardly from the top wall, the anchoring means includes a shoe, first and second fasteners, and a releasable retainer, the shoe includes an upper plate extending along the top wall, a rear plate depending from the upper plate and extending along the rear wall, and a retainer receiver plate extending upwardly from a junction formed between the upper plate and the rear plate and receiving the releasable retainer, the first fastener extends through the upper plate and the top wall into the core, and the second fastener extends through the rear plate and the rear wall into the core.

3. A concrete screed comprising a screed bar formed to include an interior region, a bar mover adapted to move the screed bar over concrete, the bar mover including a first attachment portion, and a mount coupling the bar mover to the screed bar, the mount including a core positioned in the interior region and a first anchor anchoring the first attachment portion to the core without the first attachment portion extending into the interior region, wherein the first anchor includes a mounting bracket positioned on the screed bar, a first fastener extending from the mounting bracket through the screed bar into the core, and a releasable retainer coupling the attachment portion to the mounting bracket for release therefrom, wherein the screed bar includes a rectangular tubular portion and a triangular tubular portion, the rectangular tubular portion has a rectangle-shaped cross-section and is formed to include a first chamber, the triangular tubular portion has a triangle-shaped cross-section and is formed to include a second chamber separated from the first chamber by a vertical common wall shared by the rectangular tubular portion and the triangular tubular portion, the core substantially fills the first chamber, the mounting bracket is positioned on the rectangular tubular portion, and the first fastener extends from the mounting bracket through the rectangular tubular portion into the core, and wherein the rectangular tubular portion includes a vertical rear wall and a horizontal top wall connecting the rear wall and the common wall, the mounting bracket includes a horizontal intermediate plate positioned in face-to-face contact with and coupled to the top wall by use of the first fastener and a second fastener which both extend through the intermediate plate and the top wall into the core, a rear plate depending from the intermediate plate along the rear wall such that the rear plate is positioned in face-to-face contact with and coupled to the rear wall by a third fastener extending through the rear plate and the rear wall into the core, a front plate rising from the intermediate plate and receiving the retainer, a reinforcement web extending from the front plate between the first and second fasteners to the intermediate plate to reinforce the front plate, a junction reinforcement rib extending along a junction formed between the intermediate plate and the rear plate to reinforce the junction, and a plate reinforcement rib extending downwardly from the junction reinforcement rib along the rear plate to reinforce the rear plate.

4. The concrete screed of claim 3, wherein the front plate is inclined relative to the intermediate plate and includes an inclined bore containing a threaded sleeve included in the first anchor and the retainer includes a threaded portion mating with the threaded sleeve in an inclined channel formed in the threaded sleeve and a lever portion coupled to the threaded portion to rotate the threaded portion to capture the attachment portion between the lever portion and the front plate and to release the attachment portion.

5. A concrete screed comprising a frame including a first foot and a second foot, a screed bar including a rectangular tubular portion and a triangular tubular portion, the rectangular tubular portion having a rectangle-shaped cross-section and being formed to include a first chamber, the triangular tubular portion having a triangle-shaped cross-section and being formed to include a second chamber separated from the first chamber by a common wall shared by the rectangular tubular portion and the triangular tubular portion, and a mount coupling the frame to the screed bar, the mount including a core positioned in the first chamber to reinforce the rectangular tubular portion, first and second shoes positioned on the screed bar outside the first and second chambers, a first fastener coupling the first shoe to the core, a second fastener coupling the second shoe to the core, a first releasable retainer coupling the first foot to the first shoe for release therefrom, and a second releasable retainer coupling the second foot to the second shoe for release therefrom, wherein the mount includes a second mounting bracket positioned on the screed bar outside the first and second chambers, a second fastener extending from the second mounting bracket through the rectangular tubular portion into the core to couple the second mounting bracket to the core, and a second releasable retainer coupling the frame to the second mounting bracket for release therefrom, and wherein the rectangular tubular portion includes a vertical rear wall parallel to the common wall and a horizontal top wall extending from the rear wall to the common wall, the first shoe includes a first mounting bracket, the second shoe includes a second mounting bracket, each of the first and second mounting brackets includes an intermediate plate positioned in face-to-face contact with the top wall, a rear plate depending from a first end of the intermediate plate and extending along the rear wall in face-to-face contact therewith, and a front plate rising from a second end of the intermediate plate, the first fastener extends from the intermediate plate of the first mounting bracket through the top wall into the core, the second fastener extends from the intermediate plate of the second mounting bracket through the top wall into the core, the first releasable retainer extends into a first bore formed in the front plate of the first mounting bracket, and the second releasable retainer extends into a second bore formed in the front plate of the second mounting bracket.

6. The concrete screed of claim 5, wherein the mount includes third, fourth, fifth, and sixth fasteners, the third fastener extends from the intermediate plate of the first mounting bracket through the top wall into the core, the fourth fastener extends from the intermediate plate of the second mounting bracket through the top wall into the core, the fifth fastener extends from the rear plate of the first mounting bracket through the rear wall into the core, and the sixth fastener extends from the rear plate of the second mounting bracket through the rear wall into the core, the first mounting bracket includes a first reinforcement web that extends from the rear plate of the first mounting bracket to the intermediate plate of the first mounting bracket and extends between the first and third fasteners, and the second mounting bracket includes a second reinforcement web that extends from the rear plate of the second mounting bracket to the intermediate plate of the second mounting bracket and extends between the second and fourth fasteners.

7. The concrete screed of claim 6, wherein each of the first, second, third, fourth, fifth, and sixth fasteners is a lag bolt.

8. A concrete screed comprising a frame including a first foot and a second foot, a screed bar including a rectangular tubular portion and a triangular tubular portion, the rectangular tubular portion having a rectangle-shaped cross-section and being formed to include a first chamber, the triangular tubular portion having a triangle-shaped cross-section and being formed to include a second chamber separated from the first chamber by a common wall shared by the rectangular tubular portion and the triangular tubular portion, and a mount coupling the frame to the screed bar, the mount including a core positioned in the first chamber to reinforce the rectangular tubular portion, first and second shoes positioned on the screed bar outside the first and second chambers, a first fastener coupling the first shoe to the core, a second fastener coupling the second shoe to the core, a first releasable retainer coupling the first foot to the first shoe for release therefrom, and a second releasable retainer coupling the second foot to the second shoe for release therefrom, and wherein the first shoe is formed to include an inclined first channel, the second shoe is formed to include an inclined second channel, the first releasable retainer extends into the first channel and includes a first lever portion located outside the first channel and over the triangular tubular portion, and the second releasable retainer extends into the second channel and includes a second lever portion located outside the second channel and over the triangular tubular portion.

9. A concrete screed comprising a frame including a first foot and a second foot, a screed bar including a rectangular tubular portion and a triangular tubular portion, the rectangular tubular portion having a rectangle-shaped cross-section and being formed to include a first chamber, the triangular tubular portion having a triangle-shaped cross-section and being formed to include a second chamber separated from the first chamber by a common wall shared by the rectangular tubular portion and the triangular tubular portion, and a mount coupling the frame to the screed bar, the mount including a core positioned in the first chamber to reinforce the rectangular tubular portion, first and second shoes positioned on the screed bar outside the first and second chambers, a first fastener coupling the first shoe to the core, a second fastener coupling the second shoe to the core, a first releasable retainer coupling the first foot to the first shoe for release therefrom, and a second releasable retainer coupling the second foot to the second shoe for release therefrom, and wherein the triangular tubular portion includes an imperforate inclined wall.

* * * * *

UNITED STATES PATENT AND TRADEMARK OFFICE

CERTIFICATE OF CORRECTION

PATENT NO. : 7,651,296 B2
APPLICATION NO. : 10/587530
DATED : January 26, 2010
INVENTOR(S) : Joseph W. Lindley It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 644 days.

Signed and Sealed this

Twenty-third Day of November, 2010

David J. Kappos

David J. Kappos
*Director of the United States Patent and Trademark Office*